United States Patent [19]

Bov, Jr. et al.

[11] Patent Number: 4,727,394

[45] Date of Patent: Feb. 23, 1988

[54] ROLL FUSING FOR LIQUID IMAGES

[75] Inventors: Raphael F. Bov, Jr., Pittsford; Dexter A. Dyer, Williamson, both of N.Y.

[73] Assignee: Xerox Corporation, Stamford, Conn.

[21] Appl. No.: 856,895

[22] Filed: Apr. 28, 1986

[51] Int. Cl.[4] ..... G03G 15/20

[52] U.S. Cl. ..... 355/3 FU; 219/216; 430/124; 432/60

[58] Field of Search ..... 355/3 R, 3 FU, 14 FU, 355/10; 219/216, 469, 470, 471; 432/59, 60; 430/98, 99, 124

[56] References Cited

U.S. PATENT DOCUMENTS

| | | | |
|---|---|---|---|
| 3,966,316 | 6/1976 | Pfeifer et al. | 355/3 R |
| 4,193,681 | 3/1980 | Tanigawa et al. | 355/3 FU |
| 4,272,666 | 6/1981 | Collin | 355/3 FU X |
| 4,324,482 | 4/1982 | Szlucha | 355/3 FU |
| 4,423,956 | 1/1984 | Gordon | 355/110 |
| 4,474,456 | 10/1984 | Kobayashi et al. | 355/14 FU |
| 4,496,235 | 1/1985 | Tamary | 355/3 FU |
| 4,550,243 | 10/1985 | Inagaki | 355/3 FU X |

*Primary Examiner*—Fred L. Braun

*Attorney, Agent, or Firm*—H. Fleischer; J. E. Beck; R. Zibelli

[57] ABSTRACT

An electrophotographic printing machine in which an electrostatic latent image recorded on a photoconductive member is developed with a liquid developer material having at least a liquid carrier with pigmented particles dispersed therein. The developed image is transferred from a photoconductive member to a sheet of support, material. Heat and pressure are applied to the developed image on the sheet of support material to vaporize substantially all of the liquid carrier transferred to the sheet of support material and to substantially permanently fuse pigmented particles to the sheet of support material in image configuration.

14 Claims, 2 Drawing Figures

ROLL FUSING FOR LIQUID IMAGES

Figure 1:
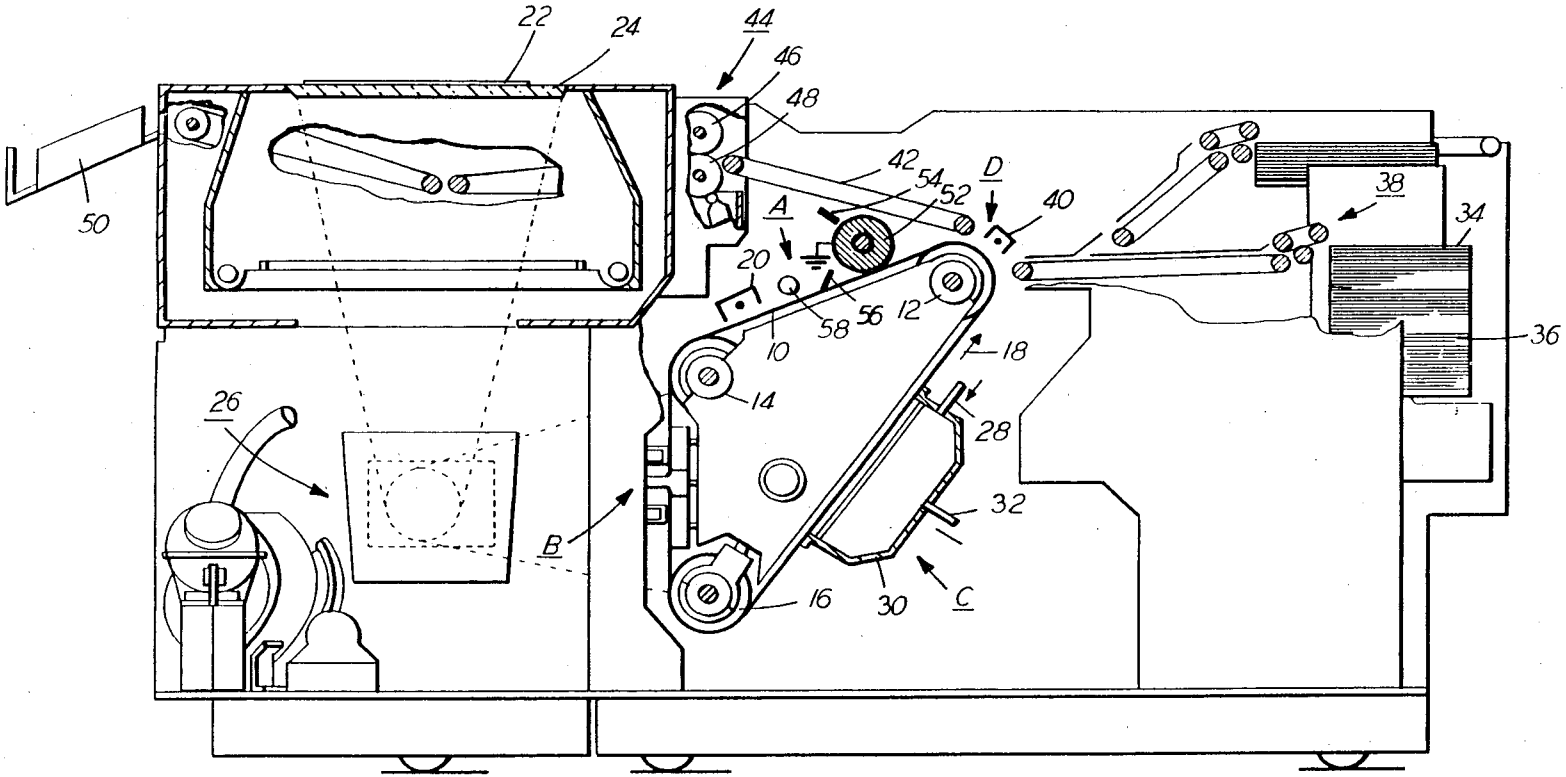

This invention relates generally to an electrophotographic printing machine, and more particularly concerns a roll fusing system for permanently fusing pigmented particles dispersed in a liquid carrier transferred to a copy sheet in image configuration.

A typical electrophotographic printing machine employs a photoconductive member that is charged to a substantially uniform potential so as to sensitize the surface thereof. The charged portion of the photoconductive member is exposed to a light image of an original document being reproduced. Exposure of the charged photoconductive member selectively dissipates the charge thereon, in the irradiated areas, to record an electrostatic latent image on the photoconductive member corresponding to the informational areas contained within the original document. After the electrostatic latent image is recorded on the photoconductive member, the latent image is developed by bringing a developer material into contact therewith. Two types of developer materials are typically employed in electrophotographic printing machines. One type of developer material is known as a dry developer material and comprises carrier granules having toner particles adhering triboelectrically thereto. Alternatively, the developer material may be a liquid material comprising a liquid carrier having pigmented particles dispersed therein. In either case, the image recorded on the photoconductive member is developed and transferred to a sheet of support material. Thereafter, the developed image on the sheet of support material is heated to permanently fuse it thereto.

When a dry developer material is employed, it is necessary to elevate the temperature of the toner particles to a point at which the constituents thereof coalesce and become tacky. This action causes the toner particles to flow, to some extent, into the fibers or pores of the copy sheet. Thereafter, as the toner material cools, solidification of the toner material occurs causing the toner material to be firmly bonded to the copy sheet. Hereinafter, dry toner particles have been permanently fused to the copy sheet by the simultaneous application of heat and pressure by a pair of rollers. The rollers are in pressure contact with one another with one of the rollers being heated. Fusing of the toner particles takes place when the proper combination of heat and contact pressure are provided. In the case of a liquid developer material, the liquid developed image on the copy sheet is heated by a radiant heater. This is necessary in order to insure that the liquid image on the copy sheet is not smeared. These printing machines typically employed radiant heaters for heating the copy sheet with the developed image thereon to permanently fix it thereto. Alternatively, heated belt conveyors were used to transport the copy sheet and permanently affix the developed image thereto. Any fusing system employed with a liquid electrophotographic printing machine must be capable of vaporizing the residual liquid carrier transferred to the copy sheet as well as permanently fusing the pigmented particles to the copy sheet in image configuration. Generally speaking, a radiant or convective system must achieve temperatures of about 400° F. in order to permanently fuse the developed image to the copy sheet. In addition, fused copies frequently have micro-voids, i.e. regions devoid of pigment with the copy sheet showing. It is desirable to reduce the fusing temperature and eliminate the formation of micro-voids. Various types of fusing systems have been employed with liquid developed images. The following disclosures appear to be relevant:

U.S. Pat. No. 3,966,316, Patentee: Pfeifer et al., Issued: June 29, 1976.

U.S. Pat. No. 4,423,956, Patentee: Gordon, Issued: Jan. 3, 1984.

The relevant portions of the foregoing disclosures may be briefly summarized as follows:

Pfeifer et al. discloses a copying machine employing a liquid developing agent and a dryer for permanently affixing the transferred liquid image to the copy sheet.

Gordon describes a vapor deposit contact printing apparatus wherein a photoconductive film having a latent image corresponding to an original film is developed with a liquid developer having toner particles suspended in an insulating liquid. Once the toner particles have been deposited on the surface of the photoconductive film, the image is air dried at a dryer station. This is necessary in order to prevent the image from smearing before it is made permanent. The image then passes through a fusing station which supplies heat by such means as a film driven fusing roller heated by an axially mounted quartz infrared lamp, air heated as it is blown over thermostatically controlled heating coils, or by using infrared radiation.

In accordance with one aspect of the features of the present invention, there is provided a reproducing machine of the type having a latent image recorded on a member. Means develop the latent image recorded on the member with a liquid developer material comprising at least a liquid carrier having pigmented particles dispersed therein. Means are provided for transferring the developed image from the member to a sheet of support material. Means apply heat and pressure to the developed image on the sheet of support material to vaporize substantially all of the liquid carrier transferred to the sheet of support material and to substantially permanently fuse the pigmented particles to the sheet of support material in image configuration with increased density and uniformity.

Pursuant to another aspect of the features of the present invention, there is provided an electrophotographic printing machine including a photoconductive member having an electrostatic latent image recorded thereon. The electrostatic latent images recorded on the photoconductive member is developed with a developer material comprising at least a liquid carrier having pigmented particles dispersed therein. Means transfer the developed image from the photoconductive member to a sheet of support material. Means are provided for providing heat and pressure to the developed image on the sheet of support material to vaporize substantially all of the liquid carrier transferred to the sheet of support material and to substantially permanently fuse the pigmented particles to the sheet of support material in image configuration with increased density and uniformity.

Figure 2:
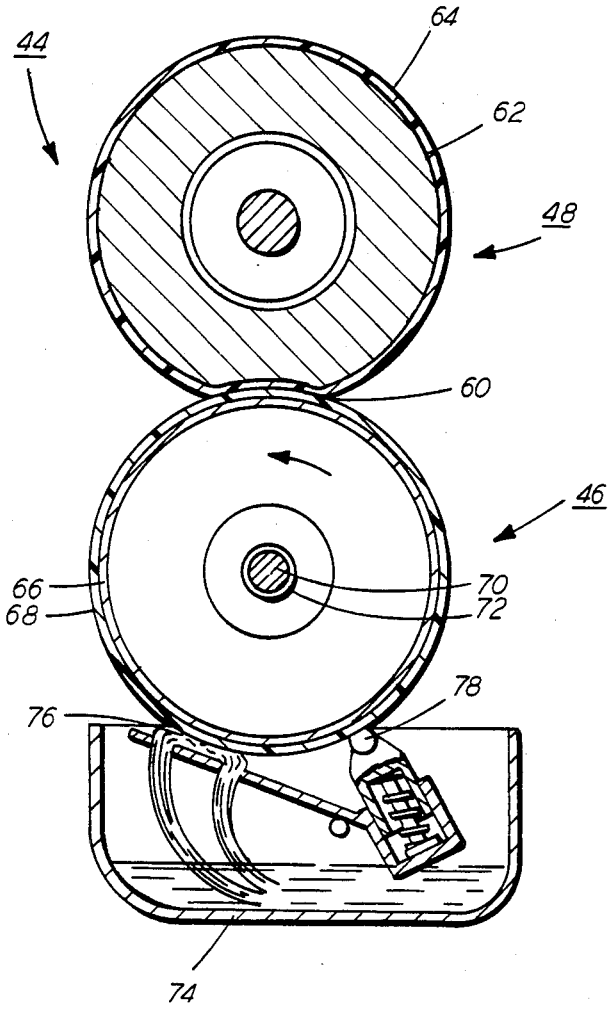

Other aspects of the present invention will become apparent as the following description proceeds and upon reference to the drawings, in which:

FIG. 1 is a schematic elevational view depicting an electrophotographic printing machine incorporating the features of the present invention therein; and FIG. 2 is an elevational view, partially in section, showing the fusing apparatus used in the FIG. 1 printing machine.

While the present invention will hereinafter be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

For a general understanding of the features of the present invention, reference is made to the drawings. In the drawings, like reference numerals have been used throughout to designate identical elements. FIG. 1 is a schematic elevational view illustrating an electrophotographic printing machine incorporating the features of the present invention therein. It will become apparent from the following discussion, that the apparatus of the present invention is equally well suited for use in a wide variety of printing machine and is not necessarily limited in this application to the particular embodiment shown herein.

Turning now to FIG. 1, the printing machine employs a belt 10 having a photoconductive surface deposited on a conductive substrate. Preferably, the photoconductive surface is made from a selenium alloy with the conductive substrate being preferably made from an aluminum alloy which is electrically grounded. Belt 10 advances successive portions of the photoconductive surface sequentially through the various processing stations disposed about the path of movement thereof. The support assembly for belt 10 includes three rollers 12, 14, and 16 located with parallel axes at approximately the apexes of a triangle. Roller 12 is rotatably driven by a suitable motor and drive (not shown) so as to rotate and advance belt 10 in the direction of arrow 18.

Initially, belt 10 passes through charging station A. At charging station A, a corona generating device 20 charges the photoconductive surface of belt 10 to a relatively high, substantially uniform potential.

After the photoconductive surface of belt 10 is charged, the charged portion thereof is advanced to exposure station B. At exposure station B, an original document 22 is placed on a transparent support platen 24. An illumination assembly, indicated generally by the reference numeral 26, illuminates the original document 22 on platen 24 to produce imaged rays corresponding to the informational areas of the original document. The image rays are projected by means of an optical system onto the charged portion of the photoconductive surface. The light image dissipates the charge in selected areas to record an electrostatic latent image on the photoconductive surface which corresponds to the informational areas contained within original document 22.

After the electrostatic latent image has been recorded on the photoconductive surface of belt 10, belt 10 advances the electrostatic latent image to development station C. At development station C, a developing liquid, comprising at least an insulating carrier liquid and toner particles, i.e. pigmented marking particles, is circulated from any suitable source (not shown) through pipe 28 into a development tray 30 from which it is drawn through pipe 32 for recirculation. Development electrodes, which may be appropriately electrically biased, assist in depositing toner particles on the electrostatic latent image as it passes in contact with the developing liquid. The charged toner particles, disseminated through the carrier liquid, pass by electrophoresis to the electrostatic latent image. The charge of the toner particles is opposite in polarity to the charge on the photoconductive surface. For example, if the photoconductive surface is made from a selenium alloy, the corona charge will be positive and the toner particles will be negatively charged. Alternatively, if the photoconductive surface is made from a cadmium sulfide material, the charge will be negative and the toner particles will have a positive charge. Normally, the amount of liquid on the photoconductive surface is excess. Accordingly, a roller (not shown) whose surface moves in a direction opposite to the direction of movement of belt 10 is spaced from the photoconductive surface and adapted to shear excess liquid from the developed image without disturbing the image. A suitable developer material is described in copending U.S. patent application Ser. No. 679,906, filed Dec. 11, 1984, the relevant portions thereof being hereby incorporated into the present application. By way of example, the insulating carrier liquid may comprise at least a hydrocarbon liquid, although other insulating liquids may also be employed. A suitable hydrocarbon liquid is an Isopar, which is a trademark of the Exxon Corporation. These are branched chained paraffinic hydrocarbon liquid (largely decane). The toner particles comprise at least a binder and pigment. The pigment may be carbon black. However, one skilled in the art will appreciate that any suitable liquid developer material may be employed.

After the electrostatic latent image is developed, belt 10 advances the developed image to transfer station D. At transfer station D, a sheet of support material 34 is advanced from stack 36, by a sheet transport mechanism, indicated generally by the reference numeral 38. Transfer station D includes a corona generating device 40 which sprays ions onto the backside of the sheet of support material 34. This attracts the developed image from the photoconductive surface of belt 10 to copy sheet 34. Ideally, only the toner particles will be transferred to the copy sheet. However, in actuality, a portion of the carrier liquid as well as well the toner particles are transferred to the copy sheet. Thus, the copy sheet is in a wet condition as it advances from transfer station D to fusing station E. Conveyor belt 42 is adapted to move the sheet of support material, i.e. the copy sheet, to fusing station E.

Fusing station E includes a fuser assembly, indicated generally by the reference numeral 44, which permanently fuses the developed image to the copy sheet. Fuser assembly 44 includes a heated fuser roll 46 and a back-up or pressure roll 48 resiliently urged into engagement therewith to form a nip through which the copy sheet passes. The detailed structure of fuser assembly 44 will be described hereinafter with reference to FIG. 2. After fusing, the finished copy is discharged to output tray 50 for removal therefrom by the machine operator.

With continued reference to FIG. 1, after a developed image is transferred to the copy sheet, residual liquid developer material remains adhering to the photoconductive surface of belt 10. A cleaning roller 52, formed of any appropriate synthetic resin, is driven in a direction opposite to the direction of movement of belt 10 to scrub the photoconductive surface clean. To assist in this cleaning action, developing liquid may be fed through pipe 54 to the surface of cleaning roller 52. A wiper blade 56 completes the cleaning of the photoconductive surface. Any residual charge left on the photoconductive surface is extinguished by flooding the photoconductive surface with light from lamps 58.

Referring now to FIG. 2, there is shown the detailed structure of fuser assembly 44. As shown thereat, fuser roll 46 and back-up roller 48 are resiliently urged into engagement with one another to form a nip 60 through which the copy sheets pass. Rollers 46 and 48 are suitably supported for rotation and driven in unison by a suitable drive means (not shown). Back-up roll 48 includes a rigid internal core 62 which may be steel, for example, over which a sleeve-like cover 66 of flexible material having non-stick properties, such as Teflon, i.e. a polytetrafluorethylene, is disposed. Fuser roll 46 similarly has a rigid internal core 66 which may, for example, be steel, having a relatively thick sleeve-like covering 68 thereover. The fuser roll sleeve 68 is composed of a flexible, image conforming material, i.e. an elastomeric material, one such material being silicone rubber. To heat fuser roll 46, a lamp 70 is disposed within the fuser roll core 66. Core 66 has a suitable opening 72 for receipt of lamp 70. In this arrangement, heat energy from lamp 70 permeates through the metal core 66 and outer sleeve 68 to heat the surface of roll 46 to the requisite temperature required to fuse the toner particles on the copy sheets.

To enchance the heating efficiency of fuser assembly 44 and reduce any tendencies for the toner particles on the copy sheet to stick to fuser roll 46, a suitable release material or agent is applied to the surface of fuser roll 46. While a release material may comprise any suitable liquid, a preferred material is silicon oil. A supply of liquid release material is stored in container 74. Applicator 76 applies the release material to the surface of fuser roll 46. Wiper 78, preferably made from a relatively soft rubber-like material such as Viton, removes any excessive release material applied to the surface of fuser roll 46. As fuser roller 46 rotates, applicator 76, which is impregnated with the liquid release material, wipes against the surface of fuser roll 46 to spread or coat roll 46 with the liquid release material. The coated surface of roll 46 is thereafter smoothed by wiper 78, excess release material being removed therefrom and deposited back in container 74.

By using a fuser assembly comprising a pair of fuser rollers, only the surface of the copy sheet is heated in the non-image areas, while the surface of the copy sheet and transferred toner particles are heated in the image areas. It is clear that the surface of the copy sheet can be heated faster by conduction and with less power then by other techniques. Faster heating of the copy sheet surface under pressure promotes melt back. Furthermore, the roll surface texture can be used to modify image gloss. Not only does the fuser roll assembly permanently affix or fuse the toner particles to the copy sheets but any residual liquid carrier adhering to the copy sheet as well as other volatile materials are readily driven therefrom. It has been found that fusing time influences the quality of the resultant image. A roll fusing assembly conducts heat into the copy sheet at at much faster rate than other techniques. This maintains more of the carrier in the toner image when the melting threshold is reached. The rapid heating under pressure dissolves the toner particles in the liquid carrier. Under these conditions of heat and pressure, the molten toner particles flow into the copy sheet and across the copy sheet surface. This reduces micro-voids and improves adhesion of the toner particles to the copy sheet. In contradistinction, images heated slowly, at atmospheric pressure, have more micro-voids. The application of pressure by the fuser rollers also improves image quality. The flow across the copy sheet results in a more uniform toner layer, and, thus, a simultaneous increase in optical density and image uniformity. It has been found that image density is increased by roll fusing. The application of pressure favorably increases image destiny. The toner spreads under the application of heat and pressure to further improve image density. The density and uniformity of the image is enhanced by roll fusing so that the image quality on rough copy sheets is nearly as good as that of smooth copy sheets. Furthermore, less toner is required to produce acceptable images when roll fusing is employed. It is thus clear that the utilization of a fuser assembly employing a heated fuser roller pressed into engagement with a back-up roller to define a nip through which the copy sheet passes significantly improves the fusing characteristics and copy quality of a liquid developer material transferred to a copy sheet.

It is, therefore, apparent that there has been provided, in accordance with the present invention, an apparatus for fusing a liquid developed image to a copy sheet that fully satisfies the aims and advantages hereinbefore set forth. While this invention has been described in conjunction with a specific embodiment thereof, it is evident that many alternatives, modifications, and variations will be apparent to those skilled in the art. Accordingly, it is intended to embrace all such alternatives, modifications and variations that fall within the spirit and board scope of the appended claims.

We claim:

1. A reproducing machine of the type having a latent image recorded on a member, wherein the improvement includes:

means for developing the latent image recorded on the member with a liquid developer material comprising at least a liquid carrier having pigmented particles dispersed therein;

means for transferring the developed image from the member to a sheet of support material;

a pressure roll; and a heated fusing roll cooperating with said pressure roll to form a fusing nip and for advancing the sheet of support material having the developed image thereon therethrough, said fusing roll cooperating with said pressure roll to advance the sheet of support material and to apply heat and pressure to the developed image on the sheet of support material so as to vaporize substantially all of the liquid carrier transferred to the sheet of support material and to substantially permanently fuse the pigmented particles to the sheet of support material in image configuration as the sheet of support material advances through the fusing nip with increased image density and uniformity at a lower energy input.

2. A reproducing machine according to claim 1, further including means for coating said fusing roll with a release material to prevent the fused pigmented particles from adhering to said fusing roll.

3. A reproducing machine according to claim 2, wherein said fusing roll includes a substantially rigid, cylindrical member having a resilient, tubular member secured to the exterior circumferential surface of said cylindrical member.

4. A reproducing machine according to claim 3, wherein said pressure roll includes a substantially rigid, cylindrical member having a polytetrafluoroethylene coating on the exterior circumferential surface thereof.

5. A reproducing machine according to claim 4, wherein the liquid carrier includes at least a dielectric liquid material.

6. A reproducing machine according to claim 5, wherein the dielectric material include at least aliphatic hydrocarbons.

7. A reproducing machine according to claim 6, wherein the pigmented particles include at least carbon black.

8. An electrophotographic printing machine, including:

a photoconductive member;

means for recording an electrostatic latent image on said photoconductive member;

means for developing the electrostatic latent image recorded on said photoconductive member with a liquid developer material comprising at least a liquid carrier having pigmented particles dispersed therein;

means for transferring the developed image from said photoconductive member to a sheet of support material;

a pressure roll; and a heated fusing roll cooperating with said pressure roll to form a fusing nip and for advancing the sheet of support material having the developed image thereon therethrough, said fusing roll cooperating with said pressure roll to advance the sheet of support and to apply heat and pressure to the developed image on the sheet of support material so as to vaporize substantially all of the liquid carrier transferred to the sheet of support material and to substantially permanently fuse the pigmented particles to the sheet of support material in image configuration as the sheet of support material advances through the fusing nip with increased image density and uniformity at a lower energy input.

9. A printing machine according to claim 8 further including means for coating said fusing roll with a release material to prevent the fused pigmented particles form adhering to said fusing roll.

10. A printing machine according to claim 9, wherein said fusing roll includes a substantially rigid, cylindrical member having a resilient, tubular member secured to the exterior circumferential surface of said cylindrical member.

11. A printing machine according to claim 10, wherein said pressure roll includes a substantially rigid, cylindrical member having a polytetrafluoroethylene coating on the exterior circumferential surface thereof.

12. A printing machine according to claim 11, wherein the liquid carrier includes at least a dielectric liquid material.

13. A printing machine according to claim 12, wherein the dielectric material include at least aliphatic hydrocarbons.

14. A printing machine according to claim 13, wherein the pigmented particles include at least carbon black.

* * * * *